US006851437B1

(12) United States Patent
Lenhart

(10) Patent No.: US 6,851,437 B1
(45) Date of Patent: Feb. 8, 2005

(54) CANE HANDLE WITH ADJUSTABLE SUPPORTING LOOP

(76) Inventor: Klaus Lenhart, Mittlerer Weg 23, D-73230 Ohmden (DE)

( * ) Notice: Subject to any disclaimer, the term of this patent is extended or adjusted under 35 U.S.C. 154(b) by 0 days.

(21) Appl. No.: 10/275,275

(22) PCT Filed: May 19, 2000

(86) PCT No.: PCT/EP00/04547

§ 371 (c)(1),
(2), (4) Date: Nov. 12, 2002

(87) PCT Pub. No.: WO01/89641

PCT Pub. Date: Nov. 29, 2001

(51) Int. Cl.[7] ..... A63C 11/22
(52) U.S. Cl. ..... 135/72; 135/76; 280/821
(58) Field of Search ..... 135/72, 911, 76; 16/436, 431, DIG. 12; 280/821

(56) References Cited

U.S. PATENT DOCUMENTS

| | | | | | |
|---|---|---|---|---|---|
| 3,113,786 | A | * | 12/1963 | Phillipson | 280/822 |
| 3,560,014 | A | * | 2/1971 | Bruckl et al. | 280/821 |
| 3,933,364 | A | * | 1/1976 | With | 280/821 |
| 4,130,293 | A | * | 12/1978 | Hinterreiter | 280/822 |
| 4,288,100 | A | * | 9/1981 | Aho | 280/821 |
| 4,288,101 | A | * | 9/1981 | Aho | 280/821 |
| 4,416,036 | A | * | 11/1983 | Aho | 24/136 R |
| 6,139,060 | A | * | 10/2000 | Lenhart | 280/821 |
| 6,439,610 | B1 | * | 8/2002 | Pronzati | 280/822 |
| 6,502,862 | B1 | * | 1/2003 | Lenhart | 280/821 |
| 2004/0000785 | A1 | * | 1/2004 | Land et al. | 280/821 |

FOREIGN PATENT DOCUMENTS

| | | | | | |
|---|---|---|---|---|---|
| DE | 257433 | | | 7/1927 | |
| DE | 7820999 | | | 11/1978 | |
| DE | 19632718 | A1 | | 7/1997 | |
| DE | 19632718 | C2 | | 7/1997 | |
| EP | 202287 | B1 | * | 7/1988 | A63C/11/22 |
| EP | 1053770 | A1 | * | 11/2000 | A63C/11/22 |
| EP | 1118362 | A2 | * | 7/2001 | A63C/11/22 |

* cited by examiner

*Primary Examiner*—Ramon O. Ramirez
*Assistant Examiner*—Ingrid Weinhold
(74) *Attorney, Agent, or Firm*—Bacon & Thomas

(57) ABSTRACT

The invention relates to a cane handle comprising a hand strap attached to the top end of the handle. Said strap forms a loop which has an adjustable length and can be fixed by means of a clamping device placed in the top end of the handle. Said clamping device comprises a clamping element which is placed in the top end of the handle and encircled by the loop. In order to adjust the hand strip more easily and to reduce the number of components required, the clamping element with the encircling section of the loop is set between an upper and a lower bearing surface, is placed in such a way that it pivots around an approximately horizontal axis, and has a clamping area which is eccentric in relation to the swivelling axis.

14 Claims, 2 Drawing Sheets

CANE HANDLE WITH ADJUSTABLE SUPPORTING LOOP

FIELD OF THE INVENTION

The present invention relates to a cane handle having a hand loop maintained in the area of the upper handle end piece, which is formed by a loop strip and whose loop length can be changed and which can be fixed in place by means of a clamping device arranged in the handle end piece, having a clamping element, which is arranged in the handle end piece, and around which the loop strip is wrapped.

BACKGROUND OF THE INVENTION

In connection with such a cane handle, known from DE 196 32 718 C2, the clamping element of the clamping device is axially indirectly movable via a rotatably seated arresting member, wherein the arresting member is movable by means of a rotatable actuating member, and is therefor axially movable by means of a screw thread. Therefore the clamping of the hand loop takes place between the arresting member, the clamping element and the bottom of the recess in the cane handle which contains the clamping device.

With this construction, wherein the clamping force is substantially continuously adjustable, once the clamping has been set it remains constant, regardless of whether the loop is pulled upward or downward in relation to the cane handle. The transition from the clamping position to the adjusting position and vice versa must be accomplished by rotating the actuating member, which under certain circumstances can be somewhat cumbersome, particularly when wearing heavy gloves. In regard to manufacturing techniques it is necessary in connection with the known clamping device to connect a number of individual parts with each other and to mount them on the cane handle. Moreover, one end of the loop strip must be longitudinally slit for the length of the displacement capability.

It is therefore the object of the present invention to produce a cane handle of the type mentioned at the outset, wherein the adjustment of the size of the hand loop can be performed in a simpler manner and by using a reduced number of components.

SUMMARY OF THE INVENTION

To attain this object, the clamping element with the wrap section of the loop strip is arranged between an upper and a lower contact surface, is maintained pivotable around an approximately horizontal shaft and is provided with a clamping area which is eccentric in relation to the pivot shaft.

By means of the steps in accordance with the invention it is achieved that the transition from one to the other position (i.e. adjustment or clamping) is exclusively achieved by the pivot position of the clamping element. In turn, this pivot position depends on whether the hand loop is pulled downward, or horizontally, or upward in relation to the cane handle of the cane. In this way the clamping position is always present, or set, in the customary position of use (downward pull on the hand loop), so that in the meantime an unintentional displacement is not possible. An adjustment position, i.e. increasing or decreasing the loop, is possible only if the hand loop is purposely used in the horizontal or obliquely upward pulled position. This has the further advantage that when the cane is caught on an object in an unintended way, the said pull on the hand loop upward in relation to the cane handle results in a change from the clamped position to the adjusting position, so that the hand loop can be extended, which can result in the hand slipping out of the loop, and therefore in a kind of safety release. With this cane handle the separate displacement of the clamping device is not necessary, which results in a simpler manipulation and a reduced outlay for components. Moreover, the loop strip can be produced in a cost-effective manner.

A structurally robust a rapidly and easily mountable construction results when the characteristics in accordance with the present invention are provided.

A sufficient and structurally simple release of the clamping results from the characteristics in accordance with the present invention. A reinforcement of the clamping is achieved when taking the characteristics of the present invention into consideration.

A simplification of the assembly results when the characteristics of the present invention are used.

Further advantageous embodiments ensue from the further dependent claims.

BRIEF DESCRIPTION OF THE DRAWINGS

Further details of the invention can be taken from the following description, in which the invention is described in greater detail and explained by means of the exemplary embodiment represented in the drawings. Shown are in.

DESCRIPTION OF THE PREFERRED EMBODIMENT

Figure 1:
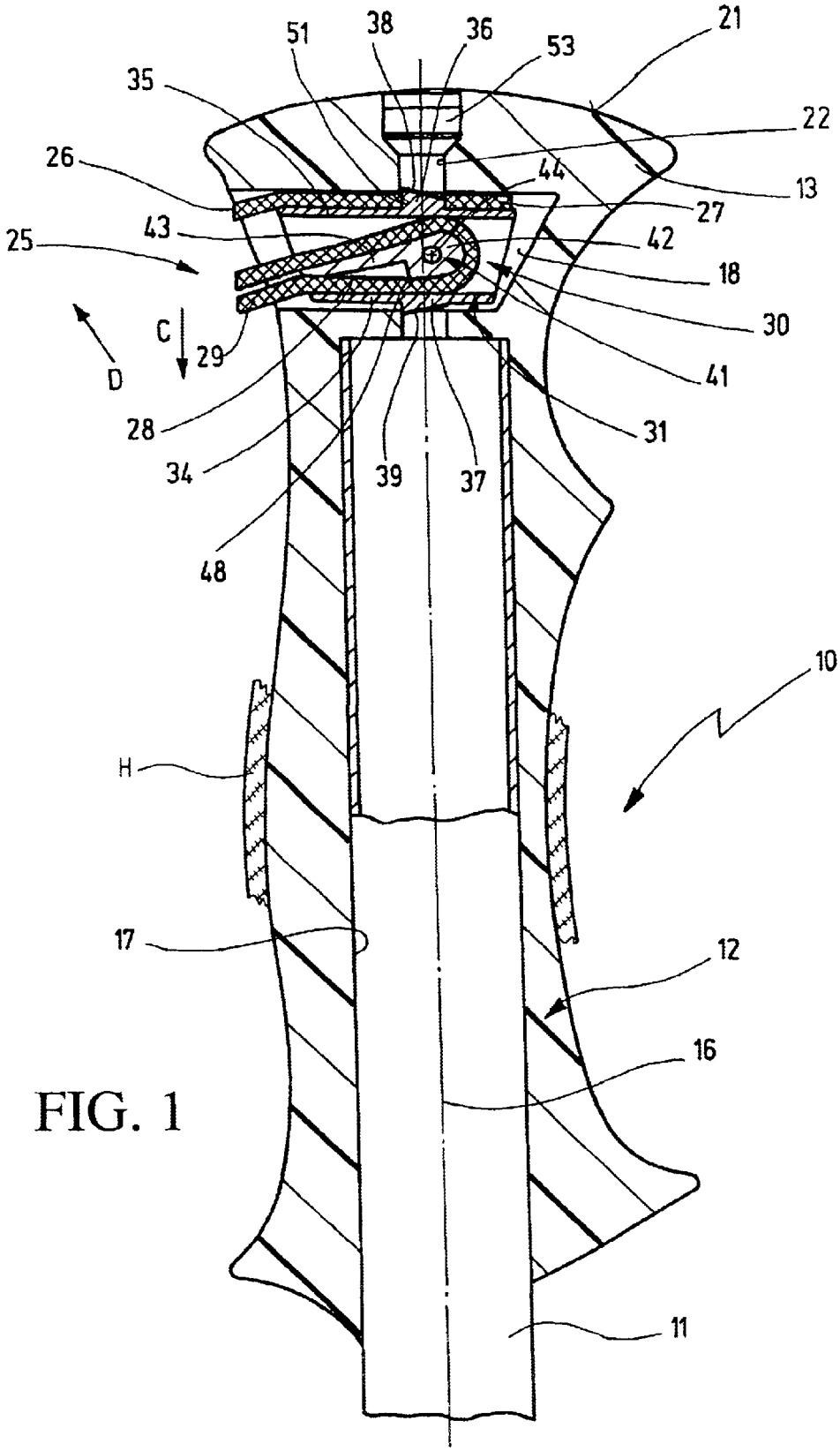
FIG. 1, a longitudinal sectional representation of a cane handle with a hand loop clamping device in accordance with a preferred exemplary embodiment of the present invention, FIG. 2, a representation corresponding to FIG. 1, but enlarged and broken off, in an adjusting position of the hand loop clamping device, FIG. 3, a section along the line III—III in FIG. 1, and FIG. 4, a section along the line IV—IV in FIG. 1.

A cane handle 10, which has a handle body 12 with an upper handle end element 13 is fixedly attached to a cane tube 11, as is represented in the drawings. The handle body consists, for example, of an inner body of a hard plastic material, for example polyamide, to which then a layer H of an easy-grip material, for example natural caoutchouc, a cork-elastomer mixture, or the like, has been applied.

The handle body 12 has a recess 18, which is laterally inserted above the end of a hollow chamber 17, which is concentric in relation to the cane tube axis 16 for receiving the cane tube 11 and which, in cross section, has a substantially rectangular cross section in the transverse direction, and a substantially trapezoidal cross section in the longitudinal direction. The depth of the recess 18 is preferably approximately ¾ of the cane handle width, or of the cane handle diameter in this area. Starting at the cane handle front face 21, a stepped bore 22, which is concentric in respect to the axis 16, has been cut, which penetrates through the recess 18 and terminates in the hollow chamber 17.

The cane handle 10 is equipped with a hand loop 25 in such a way that the length of the hand loop can be adjusted. The hand loop 25 is made from a one-piece loop strip 26, not shown in greater detail, which is narrower in the end areas 27, or 29 maintained on the cane handle 10, than in the actual intermediate area which forms the loop section, not represented.

A clamping device 30, which in the exemplary embodiment can be fastened by snapping into recess 18 of the cane handle 10, is provided for the adjustable holding of the hand loop 25 on the cane handle 10. The clamping device 30 has a housing 31, open at both ends, which is designed to be substantially rectangular in cross section in the transverse direction, and substantially trapezoidal in cross section in the longitudinal direction. Thus, the housing 31 has two parallel lateral walls 32 and 33, as well as a bottom 34 and a cover wall 35 parallel with the latter. In an area located outside of the longitudinal center, the bottom 34 and the cover wall 35 have lugs 36, 37, projecting vertically outward, which have a circular cross section and whose front 38, or 39, is slanted. The diameter of the lugs 36, 37 corresponds to the diameter of the area of a lesser diameter of the bore 22. The area of the axial bore 22 of a greater diameter, which starts from the handle head front face 21, is filled by a marker pin 53.

The clamping device 30 has a wing-shaped clamping element 41, which has a base area 42 and a wing area 43, is of one piece with the former and of less thickness, but of the same width. A pivot shaft 44, whose ends are provided with a slanted face 46 and which is seated in a bore 47 of the lateral walls 32, 33, penetrates through the base area 42, which is provided with an approximately semicircularly rounded rear facing away from the wing area 43. The clamping element 41 can therefore be pivoted around the pivot shaft 44. At the set-off-like transition between the base area 42 and the wing area 43 of the clamping element 41, the clamping element 41 is provided on its underside facing the bottom 34 with a clamping edge 48 extending over the entire width of the clamping element 41, which is at a defined radial distance from the pivot shaft 44. The design of the ends of the pivot shaft 44 make it possible for the clamping element 41 to be snapped into the housing 31 which, as mentioned, itself can be snapped into the recess 18 of the cane handle 10. Here in both cases the snap-in movement takes place in the direction toward the interior of the recess 18, in which direction the slanted faces 38, 39, or 46, also extend, so that after snapping in, the housing 31 is snapped in place in the recess 18, and the clamping element 41 in the housing in such a way that a reverse movement is no longer possible.

The end area 27 of the loop strip 26 of the hand loop 25, which is provided in a stationary manner in the cane handle 10, has been placed from the outside on the cover wall 35 of the housing 31 and is maintained on the respective lug 36 of the cover wall 35 by means of a bore 51. This means that the clear height of the recess 18 approximately corresponds to the corresponding measurement between the outer surface of the bottom 34 and the outer surface of the end area 27 of the loop strip 26 resting on the cover wall 35. Moreover, the upper lug 36 is higher by the amount of the thickness of the loop strip than the lower lug 37.

The other adjustable end area 28 of the loop strip 26, or of the hand loop 25, has been placed around the wing-like clamping element 41 in such a way that this wrap section 28 is initially placed between the top of the clamping element 41 and the inside of the cover wall 35, extends around the rounded rear surface of the base area 42 and between the underside of the base area 42 and the inner surface of the bottom 34, and then exits through the recess 18, so that the free end 29 of the loop strip 26 is located outside of the cane handle 10. The free height of the housing 31 between the bottom 34 and the cover wall 35 substantially corresponds to the approximate dimension between the two outer surfaces of the loop strip 26 placed around the clamping element 41 in the base area 42. It should be understood that, depending on the amount of force set in the course of setting or adjusting the size of the hand loop, it can be possible to provide a greater or lesser amount of frictionally connected resting of the loop strip 26 on the bottom 34, or on the cover wall 35. But generally the frictional connection achieved by the 180° of wrap of the loop strip 26 around the base area 42 is sufficient for preventing an unintentional adjustment.

Figure 2:
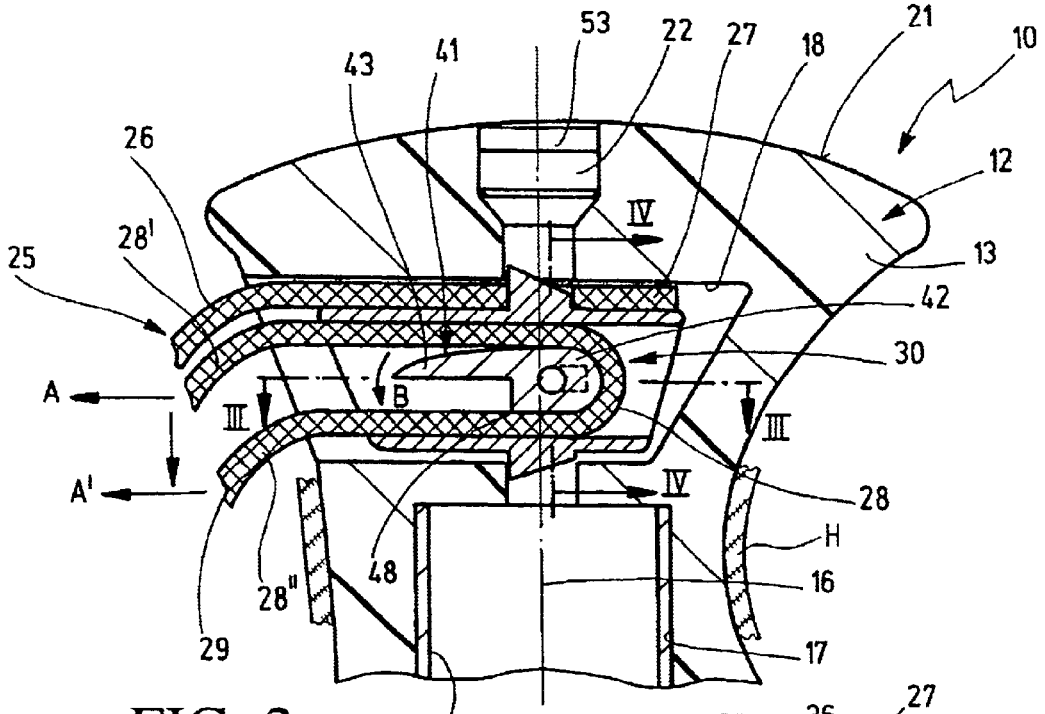
Figure 4:
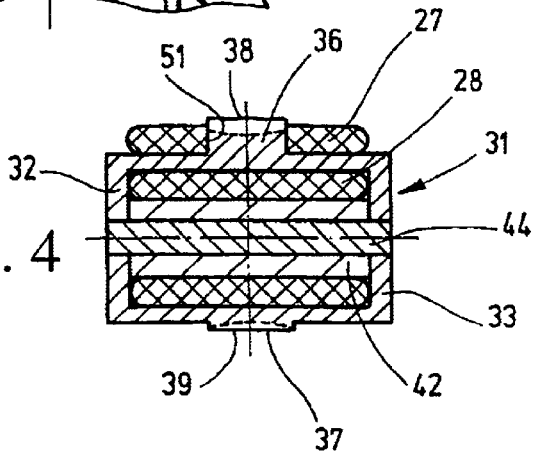
Figure 3:
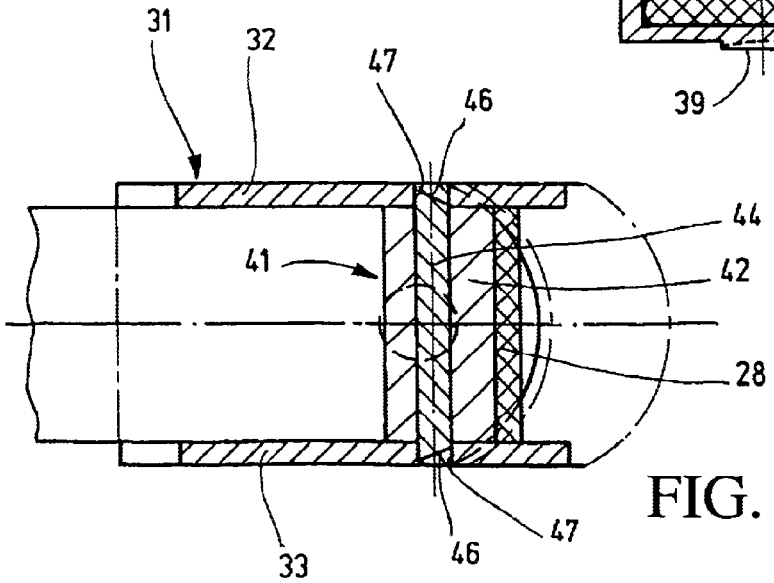

FIGS. 1 and 2 show two different positions. The adjusting position in accordance with FIG. 2, which is used for adjusting the size of the hand loop 25, shows an unstressed position of the hand loop 25, in which, because of the horizontal extension of the wrap section 28 of the loop strip 26 around the clamping element 41, the clamping element 41 itself is horizontally arranged. In this position a change of the size of the hand loop 25 is possible in that in a substantially horizontal direction in accordance with the arrow A, or A', the upper part 28' (for increasing the hand loop size), or the lower part 28" (for reducing the hand loop size), of the wrap section 28 is pulled. Once the size of the hand loop 25 has been fixed in the desired manner, further adjustment is prevented in that the hand loop 25 is pulled obliquely downward in the direction C, for example after the hand of the user has been placed inside the loop. In this stressed position the clamping element 41 is pivoted around its pivot shaft 44 in the direction of the arrow B because of the direction of the upper part and lower part 28', 28", respectively, of the loop strip 26. As can be seen in FIG. 1, the clamping edge 48 pushes on the oppositely located side of the wrap section 28 of the hand loop 25 and clamps it in place against the bottom 34 because the radial distance of the clamping edge 48 from the pivot shaft 44 is greater than the distance between the pivot shaft 44 and the inside of the respective section of the loop strip 26. Corresponding clamping can also take place in this case in an upper area along a section of the rounded rear of the base area 42 in respect to the cover wall 35.

Release from the clamping position and a change into the adjusting position results either when the hand loop 25 is no longer stressed in the direction mentioned toward the bottom, or when a stress is placed on the hand loop 25 in the reverse direction D, i.e, obliquely upward past the handle head front 21. The clamping element 41 will also reach its adjustment position in the latter case with the result that, with an appropriate tensile strain, because of the complete release of the free end of the loop strip 26 out of the clamping device 30, an increase in the size of the hand loop 25 as far as the opening of the hand loop 25 can occur. A safety triggering, or safety release of the cane handle 10 from the hand of the user is possible, or achieved in this way in case of an unintentional stress.

In accordance with a variation (dotted lines in FIG. 2), the bearing bores for the pivot shaft 44 in the lateral walls 32 and 33 are embodied as elongated hole bores extending inside the clamping device 30 in the direction of the tensile strain of the loop strip 26. Because of this an increase in the clamping effect is possible when tensile strain is introduced which initiates the clamping position. In the course of this it can also be useful to let the elongated hole bores extend obliquely downward in the direction toward the bottom 34.

The coaxial lugs 36 and 37 lie concentrically to the cane tube axis 16, while the bearing bore for the pivot shaft 44 in the lateral walls of the housing 31 extends vertically in respect to the cane tube axis 16, and is slightly offset in respect to the latter in the direction toward the inside of the recess 18.

What is claimed is:

1. A cane handle having an upper handle end piece in which an upper contact surface and a lower contact surface are arranged, a hand loop formed by a loop strip and situated at said upper handle end piece and a clamping device for fixing in place said hand loop, said hand loop having a loop length which can be changed, wherein:

said clamping device has a clamping element around which said loop strip is wrapped forming a wrap section, and a horizontal shaft about which said clamping element is pivotable, said wrap section being arranged between said upper and said lower contact surfaces, and said wrap section defining a clamping area which is eccentric in relative to said horizontal shaft.

2. The cane handle as defined in claim 1, wherein said clamping device has a housing open at its front in which said clamping element is pivotably seated and which forms said contact faces.

3. The cane handle as defined in claim 2, wherein said housing defines lateral walls which constitute pivot bearings for said clamping element, and a bottom and cover which constitute said contact faces.

4. The cane handle as defined in claim 1, wherein a pulling direction is defined for said loop strip, and said eccentric clamping area is constituted by one of: a lower corner edge, an upper corner edge and/or a rounded edge, which is acted upon in said pulling direction of said hand loop.

5. The cane handle as defined in claim 2, wherein a pulling direction is defined for said loop strip, and said housing has bores, and wherein a pivot shaft is clipped in said bores in a direction opposite to said pulling direction of said hand loop.

6. The cane handle as defined in claim 5, wherein said bores have elongated hole bores in the pulling direction of said hand loop.

7. The cane handle as defined in claim 3, wherein said upper handle end piece defines a recess, and wherein said housing is maintained snapped into said recess.

8. The cane handle as defined in claim 7, wherein a pulling direction is defined for said loop strip, and said housing has snap-in lugs which project from said bottom and said cover and which are provided with a slanted surface for a snap-in movement into axial bores of said handle in a direction opposite to said pulling direction of said hand loop.

9. The cane handle as defined in claim 2, wherein said hand loop has one non-adjustable end which is maintained on an exterior of said housing.

10. The cane handle as defined in claim 9, wherein said housing has snap-in lugs, and wherein said snap-in lugs penetrate said one non-adjustable end.

11. The cane handle as defined in claim 10, wherein the cane handle defines a longitudinal axis, and said snap-in lugs, or said bores, lie concentrically with respect to said longitudinal axis of said cane handle.

12. The cane handle as defined in claim 5, wherein the cane handle defines a longitudinal axis and a pivot axis, and said pivot axis extends vertically with respect to said longitudinal axis of said cane handle and is offset in relation to said longitudinal axis.

13. The cane handle as defined in claim 1, wherein said loop strip defines a wrap angle and said wrap angle of said loop strip at said clamping element is approximately 180°.

14. A cane handle having an upper handle end piece including a recess defined therein, a hand loop formed by a loop strip and situated partly in said recess, and a clamping element mounted within said recess to pivot therein, said clamping element fixing in place said hand loop, said hand loop having a length which can be changed, wherein:

said loop strip is wrapped relative to said clamping element forming a wrap section, with said wrap section being located in said recess, and said wrap section defines a clamping area which is eccentric relative to the pivot point of said clamping element.

* * * * *